US008727902B2

(12) United States Patent
Shipman

(10) Patent No.: US 8,727,902 B2
(45) Date of Patent: May 20, 2014

(54) GOLF PUTTING AID

(71) Applicant: Robert P. Shipman, Greenwood, MO (US)

(72) Inventor: Robert P. Shipman, Greenwood, MO (US)

( * ) Notice: Subject to any disclaimer, the term of this patent is extended or adjusted under 35 U.S.C. 154(b) by 0 days.

(21) Appl. No.: 13/872,820

(22) Filed: Apr. 29, 2013

(65) Prior Publication Data

US 2013/0288828 A1 Oct. 31, 2013

Related U.S. Application Data

(60) Provisional application No. 61/639,512, filed on Apr. 27, 2012.

(51) Int. Cl.
*A63B 69/36* (2006.01)

(52) U.S. Cl.
USPC ..... 473/265; 473/268

(58) Field of Classification Search
USPC ..... 473/257, 261–266, 268, 270–277, 422, 473/453, 409, 150, 153, 154, 157, 159, 170, 473/171, 173, 174, 175
See application file for complete search history.

(56) References Cited

U.S. PATENT DOCUMENTS

| | | | | |
|---|---|---|---|---|
| 4,736,952 | A * | 4/1988 | Taft et al. | 473/218 |
| 5,209,484 | A * | 5/1993 | Randall | 473/265 |
| 5,375,833 | A * | 12/1994 | Marier, Jr. | 473/261 |
| 5,882,267 | A * | 3/1999 | Roe | 473/265 |
| 6,695,710 | B2 * | 2/2004 | Yamada | 473/265 |
| 6,949,030 | B1 * | 9/2005 | Gauer | 473/257 |
| 7,004,851 | B2 * | 2/2006 | Pierce | 473/261 |
| 7,086,953 | B2 * | 8/2006 | Pinder | 473/174 |
| 7,431,661 | B1 * | 10/2008 | Cailey | 473/257 |
| 7,666,106 | B1 * | 2/2010 | Hebert | 473/215 |
| 2003/0027657 | A1 * | 2/2003 | Yamada | 473/265 |
| 2004/0147331 | A1 * | 7/2004 | Feller | 473/173 |
| 2005/0130756 | A1 * | 6/2005 | Chang | 473/257 |

* cited by examiner

*Primary Examiner* — Nini Legesse
(74) *Attorney, Agent, or Firm* — Hovey Williams LLP

(57) ABSTRACT

A golf putting aid comprises first and second substantially vertically extending members and a substantially horizontally extending member attached between the first and second vertically extending members. The horizontally extending member and the vertically extending members cooperatively define a first at least partially enclosed space beneath the horizontally extending member through which a golf ball may be putted and a second at least partially enclosed space above the horizontally extending member through which a golf ball may be aligned a target for the golf ball.

17 Claims, 3 Drawing Sheets

GOLF PUTTING AID

RELATED APPLICATION

This non-provisional patent application claims priority benefit, with regard to all common subject matter, of earlier-filed U.S. Provisional Patent Application No. 61/639,512, filed Apr. 27, 2012, and entitled "GOLF PUTTING AID." The identified earlier-filed provisional application is hereby incorporated by reference in its entirety into the present application.

BACKGROUND

Most golfers can significantly improve their scores by learning to putt properly. Proper putting requires golfers to position their eyes directly above a golf ball, position their eyes at a correct vertical height above the golf ball, and correctly gauge a distance of a target from the golf ball.

SUMMARY OF THE INVENTION

Applicant has noticed that golfers do not always properly position their eyes directly above a golf ball when attempting to putt the golf ball. Applicant has also noticed that golfers do not always position their eyes at a correct vertical height above the golf ball, and that golfers often have trouble gauging a distance of a target from the golf ball. Embodiments of the current invention solve the above-mentioned problems and provide a distinct advance in the art of golf putting aids and methods for instructing a golfer to putt a golf ball. More particularly, embodiments of the invention provide a simple yet highly effective golf putting aid that permits a golfer to determine when his eyes are properly positioned directly above a golf ball by visually aligning a hole or other target with the golf putting aid. Embodiments of the current invention also assist the golfer in determining when his eyes are at a correct vertical height above the golf ball and determining a distance of the target from the golf ball.

An embodiment of the golf putting aid comprises first and second vertically extending members and a horizontally extending member attached between the first and second vertical members. The first and second vertical members are generally spaced between 2 to 6 inches apart. The horizontal member and the vertical members cooperatively define a first partially enclosed space beneath the horizontal member through which a golf ball may be putted and a second partially enclosed space above the horizontal member through which a golfer may align a target for the golf ball.

In use, the golf putting aid is placed between the target and the golf ball with the partially enclosed spaces occupying a plane perpendicular to a line between the target and the golf ball. The golfer assumes a putting stance, positioning his eyes above the golf ball. In this example, the golfer is assumed to be left-handed. The golfer then looks in the direction of the target, which will appear between the vertical members. If the target appears closer to the left vertical member, the golfer should move his head horizontally toward the golf ball, until the target appears halfway between the vertical members. If the target appears closer to the right vertical member, the golfer should move his head horizontally toward his body, until the target appears halfway between the vertical members. This ensures that the golfer's eyes are properly positioned directly above the golf ball. The golfer then attempts to putt the golf ball through the first partially enclosed space and toward the target.

Other embodiments of the golf putting aid may also include vertically extending extension posts that extend above the vertical members. The extension posts increase the height of the second partially enclosed space to assist the golfer in aligning the golf ball with the target when the golf ball is nearer the target. The vertical members are generally configured to receive or support the vertical extension posts.

Other embodiments of the golf putting aid may be selectively adjustable to increase or decrease the distance between the vertical members and thus the widths of the partially enclosed spaces through which the golf ball is putted. In such embodiments, the horizontal member is selectively adjustable in length and includes telescoping, collapsible, or otherwise adjustable sections. The horizontal member may also be removably connected to the vertical members and replaced with shorter or longer horizontal members. This permits the golfer or an instructor to shorten or adjust the horizontal member and thereby decrease the widths of the partially enclosed spaces as the golfer's skill level increases.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
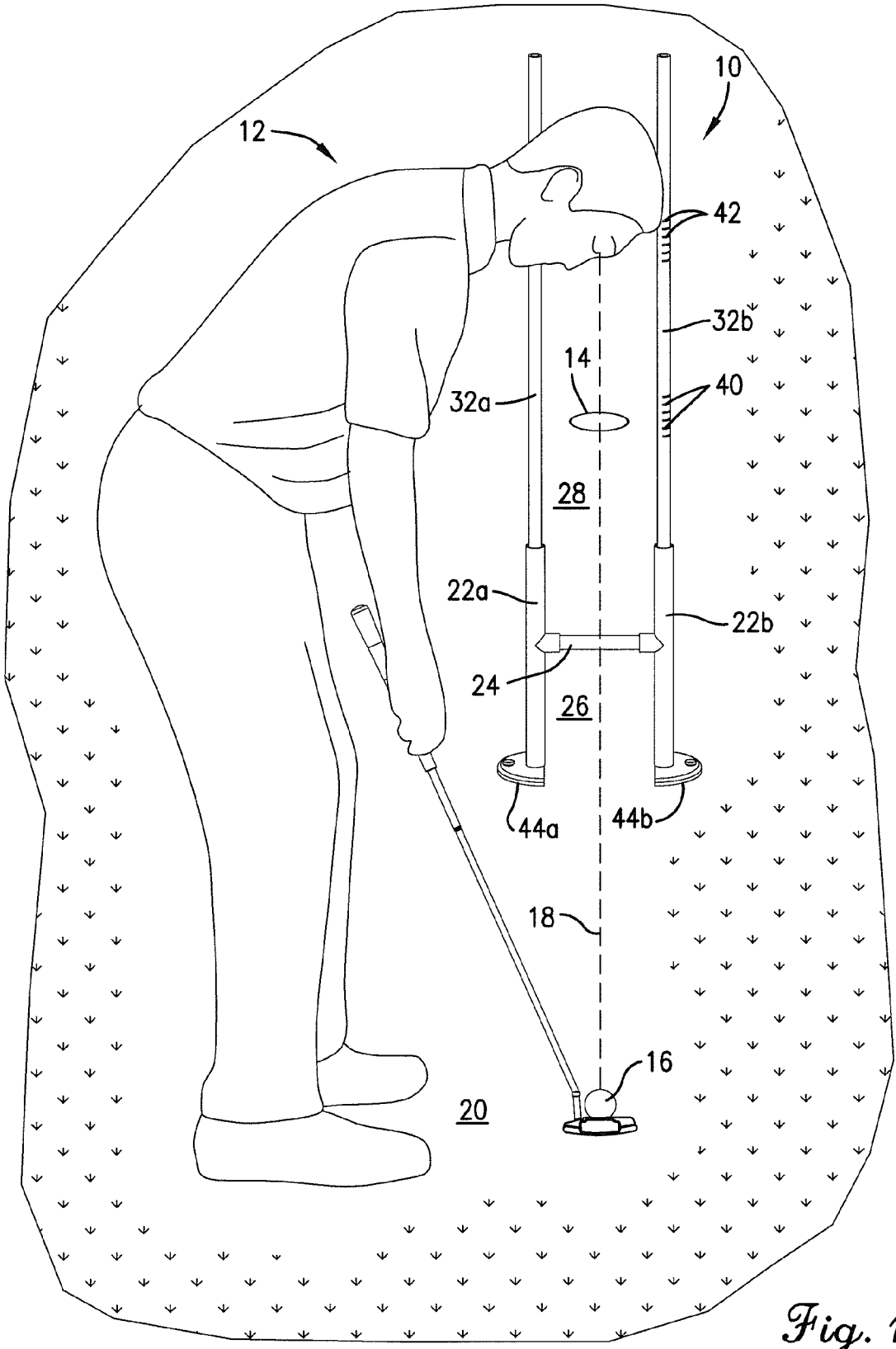
FIG. 1 is a perspective view of a golf putting aid constructed in accordance with an embodiment of the present invention and shown being used by a golfer to align a target with a golf ball and to position his eyes directly above the golf ball.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning now to the drawing figures, and initially FIG. 1, a golf putting aid 10 constructed in accordance with embodiments of the invention is shown being used by a golfer 12 to align a target 14 with a golf ball 16 and to properly position his eyes directly above the golf ball 16 (proper alignment and positioning represented by vertical dashed line 18). The golf putting aid 10 may be placed on a putting surface 20 such as a putting green (FIG. 1) or a practice mat and broadly comprises first and second vertically extending members 22*a,b* and a horizontally extending member 24 attached between the vertical members 22*a,b*. The vertical members 22*a,b* and the horizontal member 24 cooperatively define a first partially enclosed space 26 beneath the horizontal member 24 through which the golf ball 16 may be putted and a second partially enclosed space 28 above the horizontal member 24 through which the golfer 12 may align the target 14 with the golf ball 16.

The vertical members 22*a,b* are generally from about 0.5 to 3 inches thick and preferably about 1.5 inches thick, and from about 4 to 18 inches in height and preferably about 18 inches in height. The vertical members 22*a,b* may be cylindrical, square, rectangular, flat, or other shape, and may be solid or hollow. The vertical members 22*a,b* may be formed of any suitable material such as PVC pipe, plastic, rubber, metal, and wood. The vertical members 22*a,b* are generally spaced between 2 to 6 inches apart, and preferably about 6 inches apart. The vertical members 22*a,b* may include first and second sockets 30*a,b* spaced from 3 to 6 inches and preferably about 6 inches above their lower ends. The sockets 30*a,b* face each other for receiving the horizontal member 24. The vertical members 22*a,b* may be configured to receive or support first and second vertically extending extension posts 32*a,b* (described below).

The horizontal member 24 is generally from about 0.5 to 3 inches thick and preferably about 1.5 inches thick. The horizontal member 24 may be cylindrical, square, rectangular, flat, or other shape, and may be solid or hollow. The horizontal member 24 may be formed of any suitable material such as PVC pipe, plastic, rubber, metal, and wood. The horizontal member 24 may be integrally formed with the vertical members 22*a,b*, may be an individually formed piece permanently joined with the vertical members 22*a,b*, or may be connectable to and removable from the vertical members 22*a,b* via the sockets 30*a,b*, as best shown in FIGS. 2 and 3.

The horizontal member 24 may be selectively adjustable in length to increase or decrease the distance between the vertical members 22*a,b* and thus the widths of the partially enclosed spaces 26, 28 (described below), and may include telescoping, collapsible, or otherwise adjustable sections. The horizontal member 24 may also be removably connected to the vertical members 22*a,b* and replaced with shorter or longer horizontal members 24. For example, the golfer 12 or an instructor may shorten the horizontal member 24 and thereby decrease the widths of the partially enclosed spaces 26, 28 as the golfer's skill level increases. In one embodiment, and as detailed in FIG. 2, the horizontal member 24 includes first and second telescoping sections 34*a,b*, a plurality of holes 36 in one section (34*a* in FIG. 2) and a spring biased interlocking pin 38 in the other section (34*b* in FIG. 2) and operable to selectively engage one of the holes 36 for setting a desired length.

The first partially enclosed space 26 is from 2 to 6 inches wide and preferably about 6 inches wide, and from 3 to 6 inches tall and preferably about 6 inches tall. The second partially enclosed space 28 is from 2 to 6 inches wide and preferably about 6 inches wide, and from 1 to 15 inches tall and preferably about 12 inches tall. The second partially enclosed space 28 may be heightened as described below.

Figure 2:
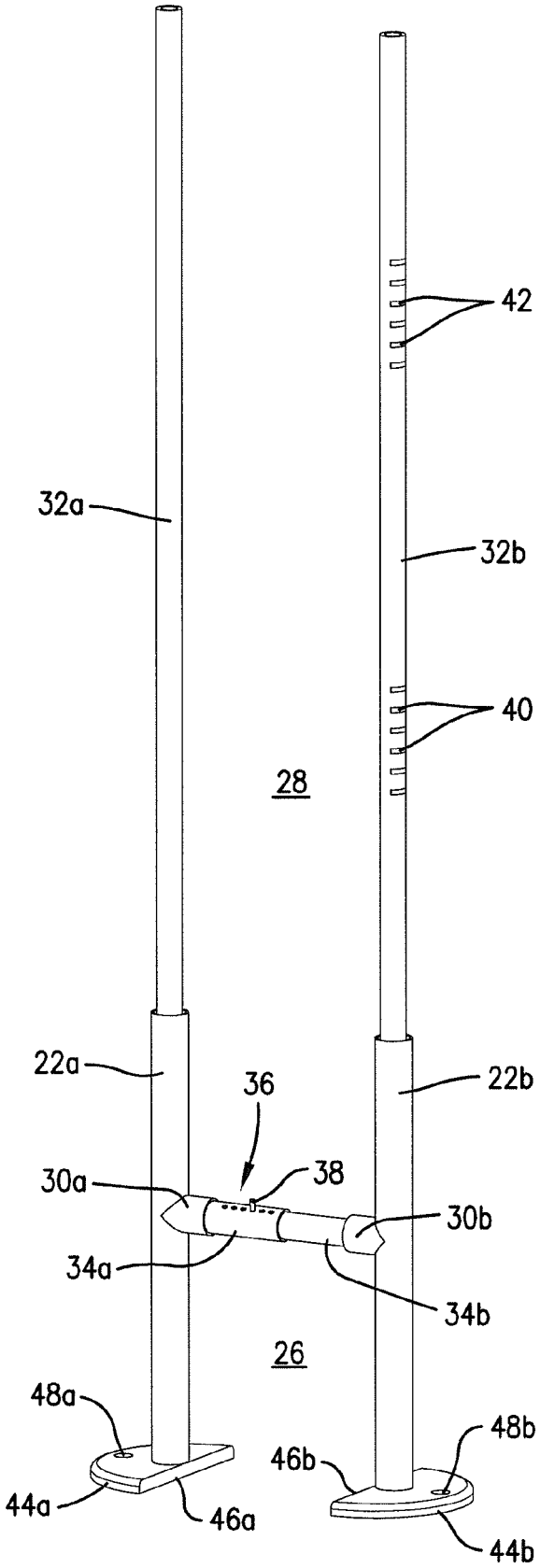
FIG. 2 is an enlarged perspective view of the golf putting aid of FIG. 1.
Figure 3:
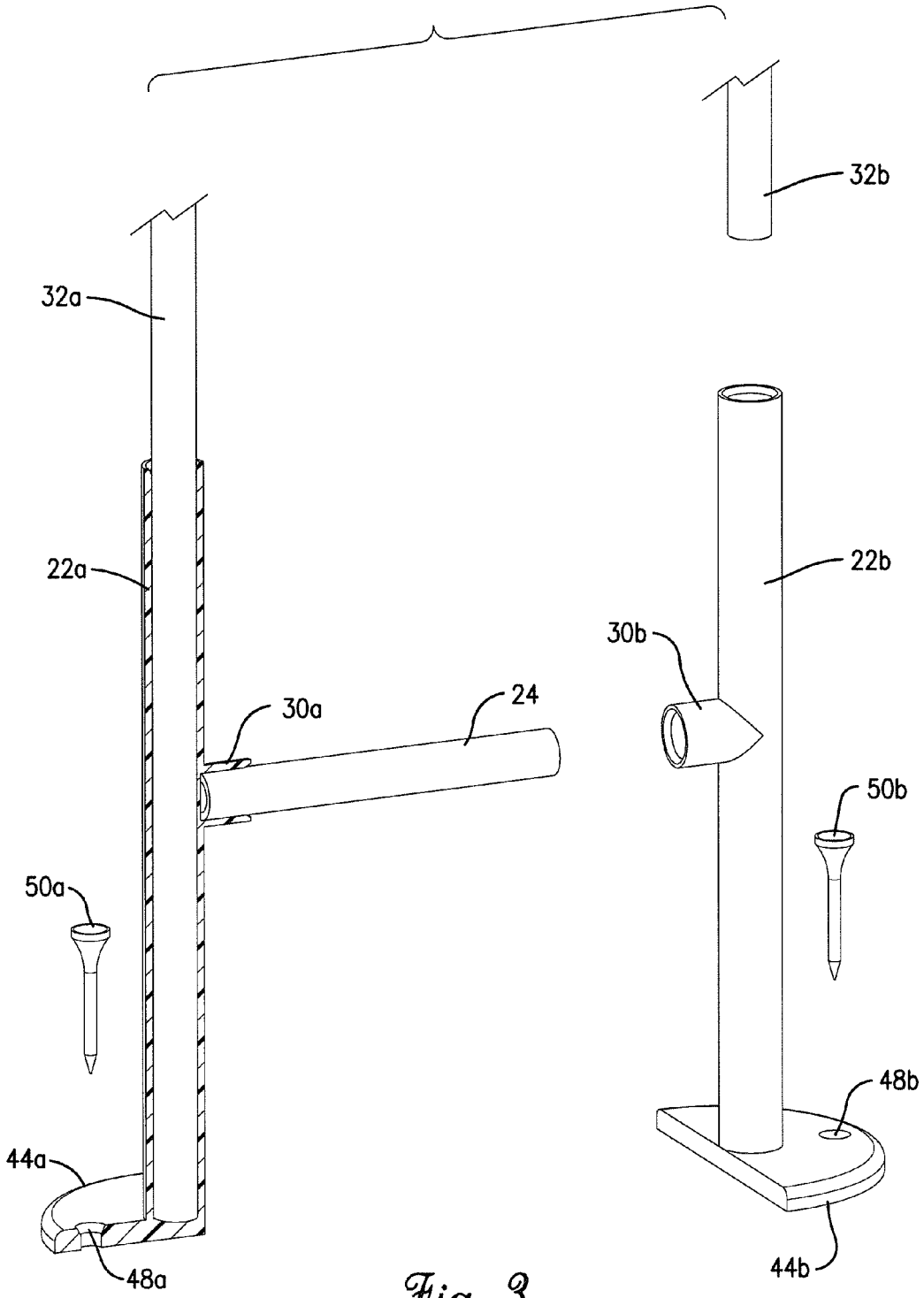
FIG. 3 is an exploded view of the golf putting aid of FIG. 1.

An embodiment of the golf putting aid 10 may also include first and second vertically extending extension posts 32*a,b* that are received within and extend above the vertical members 22*a,b*, as shown in FIGS. 1-3. The extension posts 32*a,b* heighten the second partially enclosed space 28 to assist the golfer 12 in aligning the target 14 with the golf ball 16 when the golf ball 16 is nearer the target 14.

The extension posts 32*a,b* are between 18 to 48 inches tall, and preferably about 48 inches tall, and thus heighten the second partially enclosed space 28 between 18 to 48 inches, and preferably 48 inches. The extension posts 32*a,b* may be cylindrical, square, rectangular, flat, or other shape, and may be solid or hollow. The extension posts 32*a,b* may be formed of any available material such as PVC pipe, plastic, fiberglass, rubber, metal, and wood. The extension posts 32*a,b* may be integrally formed with the vertical members 22*a,b*, or may be removable therefrom, as shown in FIGS. 1-3. In one embodiment, and as best shown in FIG. 3, the vertical members 22*a,b* are hollow, and the extension posts 32*a,b* are disposed inside the hollow vertical members 22*a,b*. Those skilled in the art will readily understand that the extension posts 32*a,b* can instead be hollow and fit over the top of the vertical members 22*a,b*.

The extension posts 32*a,b* may include a plurality of distance indicators 40, as shown in FIGS. 1 and 2. The distance indicators 40 may be marks, notches, or other indicators and may include indicia such as distances corresponding to a distance to the target 14. The golfer 12 observes the distance indicator 40 that appears closest to the target 14 when the golfer 12 looks at the target 14 through the second partially enclosed space 28, to determine the distance to the target 14, and uses the corresponding distance to judge how hard to hit the golf ball 16.

The extension posts 32*a,b* may further include a plurality of eye height indicators 42. The eye height indicators 42 may be marks, notches, or other indicators and may include indicia such as heights corresponding to a height of the golfer's eyes above the golf ball 16. The golfer 12 observes the eye height indicator 42 that is vertically closest to his eye level to determine the height of his eyes above the golf ball 16. The golfer 12 then compares his eye height with a desired eye height. If his eye height is greater than the desired eye height, then he should lower his head, and if his eye height is less than the desired eye height, then he should raise his head, until his eye height is the same as the desired eye height.

An embodiment of the golf putting aid 10 may also include first and second bases 44*a,b*, as shown in FIGS. 1-3. The bases 44*a,b* are generally wider than the vertical members 22*a,b* to provide a stable support for the golf putting aid 10. The bases 44*a,b* may be formed of any available material such as PVC pipe, plastic, fiberglass, rubber, metal, and wood. The bases 44*a,b* may be weighted by being formed of a dense material such as metal or filled with a dense material such as sand or water, and may be weighted from 2 to 10 pounds each and preferably about 5 pounds each. The bases 44*a,b* may be integrally formed with the vertical members 22*a,b* or removable therefrom and connectable thereto.

The bases 44*a,b* each include a straight side 46*a,b*, and the straight sides 46*a,b* are parallel and face each other, as shown in FIGS. 1 and 2. The straight sides 46*a,b* help to ensure that the golf putting aid 10 is properly set up and aligned with the target 14 and the golf ball 16, and enable the bases 44*a,b* to provide maximum support without interfering with the golf ball 16.

The bases 44*a,b* each include a vertical through hole 48*a,b* through which fasteners 50*a,b* may be inserted, as shown in FIGS. 2 and 3. The fasteners 50*a,b* penetrate the putting surface 20 and secure the golf putting aid 10 thereto. The fasteners 50*a,b* may be golf tees (FIG. 3), screws, nails, sticks, or other fasteners.

The present invention further includes a method of instructing a golfer to putt. In this example, the golfer is left-handed. Turning again to FIG. 1, the golfer 12 or an instructor first places the golf putting aid 10 on the putting surface 20 and between the target 14 and the golf ball 16. The golf putting aid 10 should be oriented so that the partially enclosed spaces 26, 28 occupy a plane perpendicular to a line from the target 14 to the golf ball 16. The golf putting aid 10 should be spaced sufficiently from the golf ball 16 that the golfer 12 has ample space to perform a putting swing. Once the golf putting aid 10 is positioned in this manner, the golfer 12 or instructor fastens the golf putting aid 10 to the putting surface 20 by inserting the fasteners 50*a,b* through the through holes 48*a,b* until the fasteners 50*a,b* penetrate the putting surface 20.

The instructor then instructs the golfer 12 to position his eyes above the golf ball 16 while visually aligning the target 14 through the second partially enclosed space 28. The golfer 12 can look in the direction of the target 14, which will appear horizontally between the extension posts 32*a,b*. If the target 14 appears closer to the left extension post (30*a* in FIG. 1), then the golfer 12 should move his head horizontally toward the golf ball 16 and away from his body, until the target 14 appears halfway between the extension posts 32*a,b*. If the target 14 appears closer to the right extension post (30*b* in FIG. 1), then the golfer 12 should move his head horizontally toward his body, until the target 14 appears halfway between the extension posts 32*a,b*. Finally the instructor instructs the golfer 12 to attempt to putt the ball 16 through the first partially enclosed space 26 and toward the target 14.

If the golf putting aid 10 has distance indicators 40, then the method may include the step of instructing the golfer 12 to use the distance indicators 40 to gauge a distance from the golf ball 16 to the target 14. The golfer 12 observes the distance indicator 40 that appears closest to the target 14 when the golfer 12 looks at the target 14 through the second partially enclosed space 28, to determine the distance to the target 14, and uses the corresponding distance to judge how hard to hit the golf ball 16.

If the golf putting aid 10 has eye height indicators 42, then the method may include the step of instructing the golfer 12 to use the eye height indicators 42 to gauge a vertical height between his eyes and the golf ball 16. The golfer 12 observes the eye height indicator 42 that is vertically closest to his eye level to determine the height of his eyes above the golf ball 16. The golfer 12 then compares his eye height with a desired eye height. If his eye height is greater than the desired eye height, then he should lower his head, and if his eye height is less than the desired eye height, then he should raise his head, until his eye height is the same as the desired eye height.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A golf putting aid comprising:

a first substantially vertically extending member;

a second substantially vertically extending member, the first and second vertically extending members spaced at least 2 inches apart;

a substantially horizontally extending member attached between the first and second vertically extending members, the first and second vertically extending members and the horizontally extending member cooperatively defining a first at least partially enclosed space beneath the horizontally extending member through which a golf ball may be putted and a second at least partially enclosed space above the horizontally extending member through which a golfer may align a target for the golf ball; and a plurality of distance indicators whereby a golfer may gauge a distance between the golf ball to be struck and the target.

2. The golf putting aid of claim 1, wherein the vertically extending members are between 0.5 and 3 inches thick.

3. The golf putting aid of claim 1, wherein the horizontally extending member is between 0.5 and 3 inches thick.

4. The golf putting aid of claim 1, wherein a length of the horizontally extending member is adjustable to adjust a distance between the first and second vertically extending members and an area of the first at least partially enclosed space.

5. The golf putting aid of claim 1, wherein the vertically extending extension posts extend between 18 to 48 inches above the vertically extending members.

6. A golf putting aid comprising:

a first substantially vertically extending member;

a second substantially vertically extending member, the first and second vertically extending members spaced at least 2 inches apart;

a substantially horizontally extending member attached between the first and second vertically extending members, the first and second vertically extending members and the horizontally extending member cooperatively defining a first at least partially enclosed space beneath the horizontally extending member through which a golf ball may be putted and a second at least partially enclosed space above the horizontally extending member through which a golfer may align a target for the golf ball; and a plurality of eye height indicators whereby a golfer may gauge a height between his eyes and the golf ball.

7. The golf putting aid of claim 1, wherein the horizontally extending member is removable from the vertically extending members.

8. The golf putting aid of claim 7, wherein the vertically extending members each include a socket for receiving the horizontally extending member.

9. The golf putting aid of claim 1, further comprising a first vertically extending extension post and a second vertically extending extension post, each vertically extending member being at least partially hollow, for receiving one of the vertically extending extension posts therein, the plurality of distance indicators being positioned on one of the vertically extending extension posts.

10. The golf putting aid of claim 1, further comprising a first base supporting the first vertically extending member, and a second base supporting the second vertically extending member.

11. The golf putting aid of claim 10, wherein the first base includes a first straight side, the second base includes a second straight side, and the first and second straight sides are substantially parallel and face each other.

12. The golf putting aid of claim 10, wherein the first base includes a first substantially vertical hole for receiving a fastener therethrough, and the second base includes a second substantially vertical hole for receiving a fastener therethrough, for anchoring the golf putting aid to a putting surface.

13. The golf putting aid of claim 10, wherein the bases each are weighted from 2 to 10 pounds.

14. The golf putting aid of claim 6, wherein the vertically extending extension posts are removable from the vertically extending members.

15. A method of instructing a golfer to putt, the method comprising the steps of:

providing a golf putting aid having first and second vertically extending members, a horizontally extending member, and a plurality of eye height indicators, the vertically extending members and the horizontally extending member defining an at least partially enclosed space above the horizontally extending member;

positioning the golf putting aid between a golf ball and a target;

instructing the golfer to position his eyes above the golf ball;

instructing the golfer to gauge a height between his eyes and the golf ball using the eye height indicators;

instructing the golfer to visually align the target through the space; and instructing the golfer to attempt to hit the golf ball toward the target.

16. The method of claim 15, wherein the golf putting aid further includes a plurality of distance indicators, and the method further comprises the step of instructing the golfer to gauge a distance to the target using the distance indicators.

17. The method of claim 15, wherein the vertically extending members and the horizontally extending member further define an at least partially enclosed space below the horizontally extending member, and the method further comprises the step of instructing the golfer to attempt to hit the golf ball through the space below the horizontally extending member.

* * * * *